US011271350B2

(12) United States Patent
Moffitt et al.

(10) Patent No.: US 11,271,350 B2
(45) Date of Patent: Mar. 8, 2022

(54) CONNECTORS FOR A SINGLE TWISTED PAIR OF CONDUCTORS

(71) Applicant: COMMSCOPE TECHNOLOGIES LLC, Hickory, NC (US)

(72) Inventors: Bryan Scott Moffitt, Red Bank, NJ (US); Scott Martin Keith, Plano, TX (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 16/620,185

(22) PCT Filed: Jun. 8, 2018

(86) PCT No.: PCT/US2018/036623

§ 371 (c)(1),
(2) Date: Dec. 6, 2019

(87) PCT Pub. No.: WO2018/227057

PCT Pub. Date: Dec. 13, 2018

(65) Prior Publication Data

US 2021/0083441 A1 Mar. 18, 2021

Related U.S. Application Data

(60) Provisional application No. 62/516,739, filed on Jun. 8, 2017.

(51) Int. Cl.

| | |
|---|---|
| ***H01R 24/64*** | (2011.01) |
| ***H01R 31/06*** | (2006.01) |
| ***H01R 103/00*** | (2006.01) |

(52) U.S. Cl.

CPC ..... *H01R 24/64* (2013.01); *H01R 31/06* (2013.01); *H01R 2103/00* (2013.01)

(58) Field of Classification Search

CPC .. H01R 12/67; H01R 12/675; H01R 13/6463; H01R 13/65915; H01R 24/56;

(Continued)

(56) References Cited

U.S. PATENT DOCUMENTS

| | | | |
|---|---|---|---|
| 2,673,968 | A | 3/1954 | Smith |
| 2,813,257 | A | 11/1957 | Cornell, Jr. |
| 3,199,060 | A | 8/1965 | Marasco |
| 3,827,007 | A | 7/1974 | Fairbairn et al. |
| 3,828,706 | A | 8/1974 | Scott |
| 4,054,350 | A | 10/1977 | Hardesty |
| 4,449,767 | A | 5/1984 | Weidler |
| 4,458,971 | A | 7/1984 | D'Urso et al. |
| 4,565,416 | A | 1/1986 | Rudy et al. |
| 4,702,538 | A | 10/1987 | Hutter et al. |
| 4,743,208 | A | 5/1988 | Weisenburger |
| 4,744,774 | A | 5/1988 | Pauza |
| 4,824,394 | A | 4/1989 | Roath et al. |

(Continued)

FOREIGN PATENT DOCUMENTS

| | | | |
|---|---|---|---|
| CN | 1205778 | A | 1/1999 |
| CN | 1408135 | A | 4/2003 |

(Continued)

OTHER PUBLICATIONS

International Search Report and Written Opinion of the International Searching Authority for International Patent Application No. PCT/US2018/036623 dated Oct. 2, 2018, 10 pages.

(Continued)

*Primary Examiner* — Oscar C Jimenez
(74) *Attorney, Agent, or Firm* — Merchant & Gould P.C.

(57) ABSTRACT

A family of connectors to accommodate a single twisted pair of conductors is disclosed herein. The family of connectors includes a free connector, a fixed connector, and an adapter; the free and/or fixed connectors can be modified to accommodate various patch cord and mounting configurations. In certain embodiments, the one or more of the family of connectors adopts an RJ 45 style connector or RJ 45 style jack/receptacle configuration in a reduced footprint, e.g. one-half, one-third or one-quarter the size of a standard RJ 45 connector or jack/receptacle.

16 Claims, 11 Drawing Sheets

(58) Field of Classification Search
CPC ..... H01R 24/568; H01R 24/62; H01R 24/64; H01R 31/06; H01R 2103/00
See application file for complete search history.

(56) References Cited

U.S. PATENT DOCUMENTS 4,917,625 A 4/1990 Haile
4,932,906 A 6/1990 Kaley et al.
5,013,255 A 5/1991 Juret et al.
5,240,436 A 8/1993 Bradley et al.
5,368,499 A 11/1994 Hirt
5,385,476 A 1/1995 Jasper
5,496,184 A 3/1996 Garrett et al.
5,533,915 A 7/1996 Deans
5,580,264 A 12/1996 Aoyama et al.
5,604,440 A 2/1997 Tomikawa et al.
5,748,819 A 5/1998 Szentesi et al.
5,749,755 A 5/1998 Genta et al.
5,761,358 A 6/1998 Kuchenbecker et al.
5,833,496 A 11/1998 Hollander et al.
5,897,404 A 4/1999 Goodman et al.
5,915,989 A 6/1999 Adriaenssens et al.
5,984,729 A 11/1999 Hollander et al.
5,989,057 A 11/1999 Gerke et al.
6,019,521 A 2/2000 Manning et al.
6,045,389 A 4/2000 Ferrill et al.
6,045,406 A 4/2000 Cortes
6,050,845 A 4/2000 Smalley, Jr. et al.
6,065,994 A 5/2000 Hashim et al.
6,135,804 A 10/2000 Lux
6,217,230 B1 4/2001 Matsushita
6,254,440 B1 7/2001 Ko et al.
6,270,372 B1 8/2001 Jenner et al.
6,280,230 B1 8/2001 Takase et al.
6,390,687 B1 5/2002 Shirakawa
6,402,571 B1 6/2002 Muller et al.
6,488,550 B1 12/2002 Kikuchi et al.
6,499,889 B1 12/2002 Shirakawa et al.
6,568,967 B2 5/2003 Inaba et al.
6,572,276 B1 6/2003 Theis et al.
6,641,431 B2 11/2003 Saitoh
6,702,617 B1 3/2004 Clement et al.
6,793,515 B1 9/2004 Gwiazdowski et al.
7,004,797 B2 2/2006 Harada et al.
7,181,173 B1 2/2007 Daly et al.
7,201,601 B2 4/2007 Lappohn
7,217,162 B2 5/2007 Harada et al.
7,291,046 B2 11/2007 Russelburg
7,325,976 B2 2/2008 Gurreri et al.
7,537,393 B2 5/2009 Anderson et al.
7,559,789 B2 7/2009 Hashim
7,578,682 B1 8/2009 Hughes et al.
7,618,297 B2 * 11/2009 Wang ..... H01R 13/64 439/676
7,867,033 B2 1/2011 Kumagai et al.
8,052,482 B1 11/2011 Lin
8,066,526 B2 11/2011 Gentner et al.
8,079,883 B2 12/2011 Pascut
8,109,789 B2 2/2012 Tyler
8,113,889 B2 2/2012 Zhang et al.
8,172,468 B2 5/2012 Jones et al.
8,303,337 B2 11/2012 Ballard et al.
8,684,763 B2 4/2014 Mattson et al.
8,690,596 B2 * 4/2014 Su ..... H01R 13/6275 439/354
8,715,016 B2 5/2014 DeBock et al.
8,757,895 B2 6/2014 Petersen
8,840,424 B2 9/2014 Kudo
8,888,535 B2 11/2014 Knight et al.
8,915,759 B2 12/2014 Miyamoto
8,979,572 B2 3/2015 Mochizuki
9,093,807 B2 * 7/2015 O'Connor ..... H01R 24/64
9,136,652 B2 9/2015 Ngo
9,172,169 B2 10/2015 Hagio et al.
9,209,578 B2 12/2015 Mochizuki
9,356,439 B2 5/2016 Keith et al.
9,490,591 B2 11/2016 Yamashita et al.
9,590,339 B2 3/2017 Oberski et al.
9,634,417 B2 4/2017 Ramanna et al.
9,685,726 B2 6/2017 Ang et al.
9,692,161 B2 6/2017 Lindkamp et al.
9,799,981 B2 10/2017 Weber
9,853,388 B2 12/2017 Copper et al.
9,917,390 B1 3/2018 Bianca et al.
9,972,932 B2 5/2018 Copper et al.
10,061,090 B2 8/2018 Coenegracht
10,164,383 B2 12/2018 Feng
10,389,062 B2 8/2019 Zebhauser et al.
10,411,409 B2 9/2019 Hashim et al.
10,665,974 B2 5/2020 Oberski et al.
10,665,985 B2 5/2020 Keith
10,727,626 B2 * 7/2020 Murray ..... H01R 13/629
10,768,374 B2 9/2020 Gurreri et al.
11,031,719 B2 6/2021 Somanathapura Ramanna
2001/0018287 A1 * 8/2001 Reichle ..... H01R 31/06 439/374
2002/0055294 A1 5/2002 Murakami et al.
2002/0072275 A1 6/2002 Arai
2003/0228799 A1 12/2003 Machado et al.
2004/0152360 A1 8/2004 Harris et al.
2005/0227545 A1 10/2005 Lahoreau et al.
2005/0232566 A1 10/2005 Rapp et al.
2006/0134966 A1 6/2006 Lappohn
2007/0270043 A1 11/2007 Pepe et al.
2008/0057793 A1 3/2008 Gerber et al.
2009/0176415 A1 * 7/2009 AbuGhazaleh .... H01R 13/6477 439/676
2010/0003863 A1 1/2010 Siemon et al.
2010/0035454 A1 2/2010 Morgan et al.
2010/0040332 A1 2/2010 Van Den Meersschaut et al.
2010/0120284 A1 5/2010 Oka et al.
2010/0173528 A1 7/2010 Martich et al.
2010/0221951 A1 9/2010 Pepe et al.
2010/0304600 A1 12/2010 Busse
2011/0009016 A1 1/2011 Liu et al.
2011/0294342 A1 12/2011 DeBock et al.
2012/0004655 A1 1/2012 Kim et al.
2013/0075149 A1 3/2013 Golko et al.
2013/0171885 A1 7/2013 Zhang
2013/0252469 A1 9/2013 Mochizuki
2015/0083455 A1 3/2015 Keith et al.
2015/0147035 A1 5/2015 Yashar et al.
2015/0155670 A1 6/2015 Gardner
2015/0214667 A1 7/2015 Chen et al.
2015/0249295 A1 9/2015 Tseng
2016/0028198 A1 1/2016 Yamashita et al.
2016/0056597 A1 2/2016 Larsen et al.
2016/0131858 A1 5/2016 Anderson et al.
2016/0164223 A1 6/2016 Zebhauser et al.
2016/0315436 A1 10/2016 Plamondon et al.
2017/0184798 A1 6/2017 Coenegracht
2017/0207561 A1 7/2017 Scherer et al.
2017/0264025 A1 9/2017 Lappöhn
2017/0373405 A1 12/2017 Lappoehn
2019/0154923 A1 5/2019 Flaig
2019/0296491 A1 9/2019 Maesoba et al.
2020/0106216 A1 4/2020 Hashim et al.
2020/0274273 A1 8/2020 Oberski et al.
2020/0350730 A1 11/2020 Keith et al.
2021/0104842 A1 4/2021 Keith et al.
2021/0104843 A1 4/2021 Tobey et al.
2021/0151905 A1 5/2021 Novak et al.

FOREIGN PATENT DOCUMENTS

CN 102810356 A 12/2012
CN 105723571 A 6/2016
CN 106415944 A 2/2017
CN 107104329 A 2/2017
CN 209167592 U 7/2019
DE 102 16 915 A1 10/2003
EP 1 128 494 A2 8/2001
EP 1 783 871 A1 5/2007
FR 2 290 136 A7 5/1976

(56) References Cited

FOREIGN PATENT DOCUMENTS

| | | | |
|---|---|---|---|
| GB | 628 419 | A | 8/1949 |
| GB | 2510490 | A8 | 8/2014 |
| JP | H08-138797 | A | 5/1996 |
| JP | 2001-167852 | A | 6/2001 |
| JP | 4514356 | B2 | 5/2010 |
| JP | 2015-222721 | A | 12/2015 |
| KR | 10-2010-0122766 | A | 11/2010 |
| WO | 97/23797 | A1 | 7/1997 |
| WO | 2006/048867 | A1 | 5/2006 |
| WO | 2012/067945 | A2 | 5/2012 |
| WO | 2016/132855 | A1 | 8/2016 |
| WO | 2017/019370 | A1 | 2/2017 |
| WO | 2019/165466 | A1 | 8/2019 |
| WO | 2020/051340 | A1 | 3/2020 |

OTHER PUBLICATIONS

"RJ point five Connector System, Quick Reference Guide", Tyco Electronics, 4 pages (Aug. 2009).

SP-3-0235 (to be published as TIA-1096), Telecommunications, Telephone Terminal Equipment, Connector Requirement for Connection of Terminal Equipment to the Telephone Network, 72 pages (2006).

2-Pin Connector w/Header, .10", All Electronics Corporation, 3 pages, downloaded: http://www.allelctronics.com/item/con-242/2-pin-connector-w/header-.10/html (May 31, 2017).

2 Pin Connectors, Wiring Specialties, 5 pages (May 31, 2017).

DiBiaso et al., "Designing a Connection System for Gigabit Automotive Ethernet," SAE International Journal of Passenger Cars—Electronic and Electrical Systems, vol. 9, No. 1, pp. 134-146 (May 2016).

Extended European Search Report for Application No. 18813018.1 dated Feb. 2, 2021.

Office Action from Chinese Application No. 201980023438.2 dated Jun. 3, 2021, 19 pages [English translation].

U.S. Non-Final Office Action for U.S. Appl. No. 15/931,046 dated Jul. 19, 2021.

U.S. Non-Final Office Action for U.S. Appl. No. 16/081,595 dated Jul. 21, 2021.

U.S. Non-Final Office Action for U.S. Appl. No. 16/964,730 dated Jul. 28, 2021.

U.S. Non-Final Office Action for U.S. Appl. No. 16/975,891 dated Aug. 25, 2021.

U.S. Final Office Action for U.S. Appl. No. 16/608,126 dated Sep. 1, 2021.

Third Party Observation for Application No. 18813018.1 dated Sep. 22, 2021.

U.S. Non-Final Office Action for U.S. Appl. No. 16/608,126 dated Dec. 29, 2021.

U.S. Final Office Action for U.S. Appl. No. 15/931,046 dated Jan. 19, 2022.

* cited by examiner

CONNECTORS FOR A SINGLE TWISTED PAIR OF CONDUCTORS

CROSS-REFERENCE TO RELATED APPLICATION

This application is a National Stage Application of PCT/US2018/036623, filed on Jun. 8, 2018, which claims the benefit of U.S. Patent Application Ser. No. 62/516,739, filed on Jun. 8, 2017, the disclosures of which are incorporated herein by reference in their entireties. To the extent appropriate, a claim of priority is made to each of the above disclosed applications.

TECHNICAL FIELD

The present disclosure is directed to connectors and, more specifically, to connectors for use with a single-twisted pair of conductors.

BACKGROUND

A single twisted pair of conductors can be used to transmit data and/or power over a communications network that includes, for example, computers, servers, cameras, televisions, and other electronic devices including those on the internet of things (IoT), etc. In the past, this has been performed through use of Ethernet cables and connectors which typically include four pairs of conductors that are used to transmit four differential signals. Differential signaling techniques, where each signal is transmitted over a balanced pair of conductors, are used because differential signals may be impacted less by external noise sources and internal noises sources, such as crosstalk, as compared to signals that are transmitted over unbalanced conductors. In Ethernet cables, the insulated conductors of each differential pair are tightly twisted about each other to form four twisted pairs of conductors, and these four twisted pairs may be further twisted about each other in a so-called "core twist." A separator may be provided that is used to separate at least one of the twisted pairs from at least one other of the twisted pairs. The four twisted pairs and any separator may be enclosed in a protective jacket. Ethernet cables are connectorized with Ethernet connectors; a single Ethernet connector is configured to accommodate all four twisted pairs of conductors. However, it is possible that data and/or power transfer can be effectively supported through a singled twisted pair of conductors with its own more compact connector and cable. Accordingly, a connector design different from a standard Ethernet connector is needed.

SUMMARY

A family of connectors to accommodate a single twisted pair of conductors is disclosed herein. The family of connectors includes a free connector, a fixed connector, and an adapter; the free and/or fixed connectors can be modified to accommodate various patch cord and mounting configurations. In certain embodiments, the one or more of the family of connectors adopts an RJ 45 style connector or RJ 45 style jack/receptacle configuration in a reduced footprint, e.g. one-half, one-third or one-quarter the size of a standard RJ 45 connector or jack/receptacle.

An aspect of the present disclosure is directed to a connector including an RJ 45 style connector housing and only first and second insulation piercing contacts. The RJ 45 style connector housing is one-half, one-third, or one-quarter the size of a standard RJ 45 connector. The first and second contacts are contained within the connector housing and are configured to be electrically coupled to a single twisted pair of conductors.

Another aspect of the present disclosure is directed to a connector that includes an RJ 45 style jack/receptacle body portion and only first and second contacts. The body portion includes a port. Further, the body portion is one-half, one-third, or one-quarter the size of a standard RJ 45 jack/receptacle. The first and second contacts are accessible via the port and are configured to be electrically coupled to a single twisted pair of conductors or to first and second contacts of a printed circuit board.

Another aspect of the present disclosure is directed to an adapter for coupling two single twisted pairs of conductors. The adapter includes a body portion having first and second ports. Each of the first and second ports includes only first and second contacts that are accessible via the ports. The first and second contacts or the first port are electrically coupled to the first and second contacts of the second port. Each of the first and second ports is configured to interface with a two-contact only connector.

Still another aspect of the present disclosure is directed to patch cord that includes a cable having a single pair of twisted conductors. Each of the conductors includes a first end and a second end. The first ends are coupled to an RJ 45 style connector or to an RJ 45 style jack/receptacle. Similarly, the second ends of the conductors are coupled to an RJ 45 style connector or to an RJ 45 style jack/receptacle. The RJ 45 style connector and the RJ 45 style jack/receptacle are one-half, one-third or one-quarter the size of a standard RJ 45 connector or jack/receptacle.

BRIEF DESCRIPTION OF THE FIGURES

FIG. 5A is a front view of an RJ 45 jack suitable for wall plate mounting while FIG. 5B is a front view of an RJ 45 jack configured for printed circuit board mounting and shielding.

DETAILED DESCRIPTION

A family of connectors to accommodate a single twisted pair of conductors is disclosed herein. The family of connectors includes a free connector, a fixed connector, and an adapter; the free and/or fixed connectors can be modified to accommodate various patch cord and mounting configurations. In certain embodiments, the one or more of the family of connectors adopts an RJ 45 style connector or RJ 45 style jack/receptacle configuration in a reduced footprint, e.g. one-half, one-third or one-quarter the size of a standard RJ 45 connector or jack/receptacle.

Figure 1:
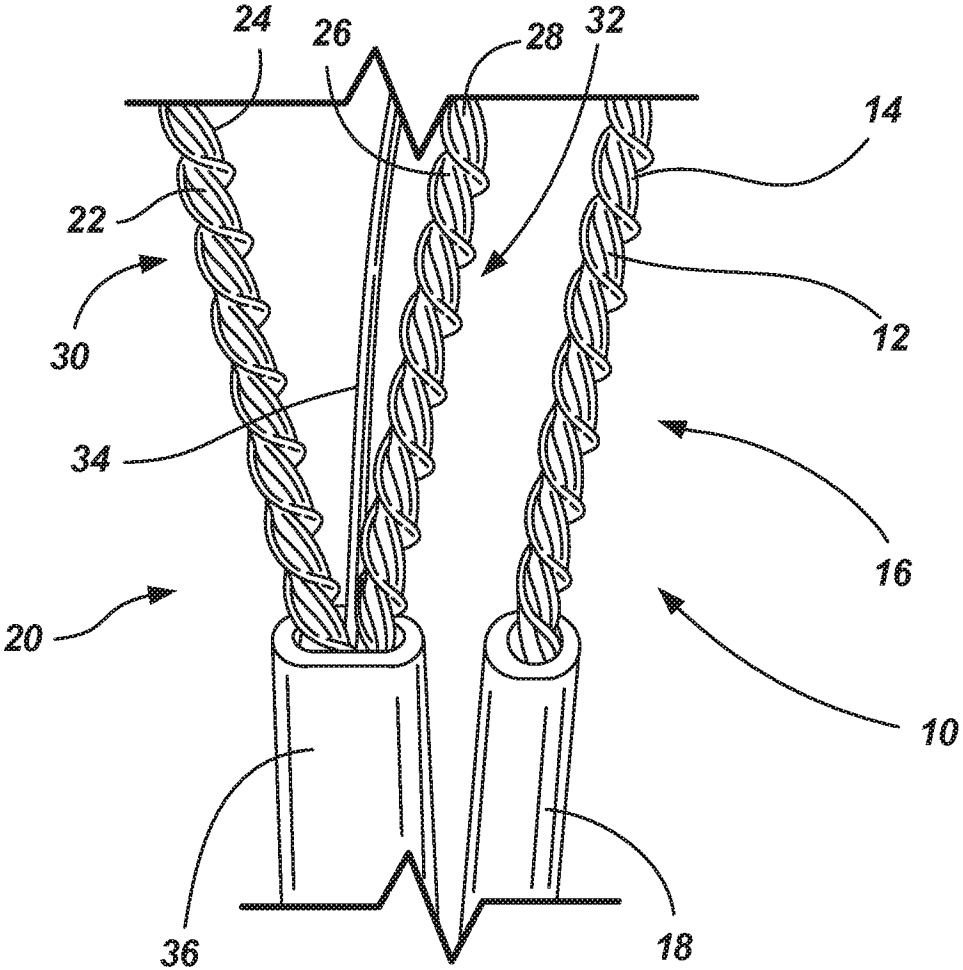
FIG. 1 illustrates example embodiments of cables having single twisted pairs of conductors.

FIG. 1 illustrates two example embodiments of cables containing one or more single twisted pairs of conductors. The first cable 10 includes first and second conductors 12, 14 that are twisted together to form a single twisted pair 16. The conductors 12, 14 are enclosed by a protective jacket 18. The second cable 20 includes first through fourth conductors 22, 24, 26, 28. Conductors 22 and 24 are twisted together to form a first single twisted pair 30, and conductors 26 and 28 are twisted together to form a second single twisted pair 32. The twisted pairs 30 and 32 are separated by a separator 34, and are encased in a protective jacket 36. In certain example embodiments, the cables 10, 20 include a number of twisted pairs greater than two. In certain example embodiments, each single twisted pair of conductors, e.g., 16, 30, 32, is configured for data transmission up to 600 MHz (ffs) and has a current carrying capacity up to 1 A. Each single twisted pair of conductors, e.g., 16, 30, 32, can be connectorized with the various embodiments or combination of embodiments of free connectors and fixed connectors as described herein. The connectorized twisted pairs can be coupled with an adapter as described herein.

Figure 2B:
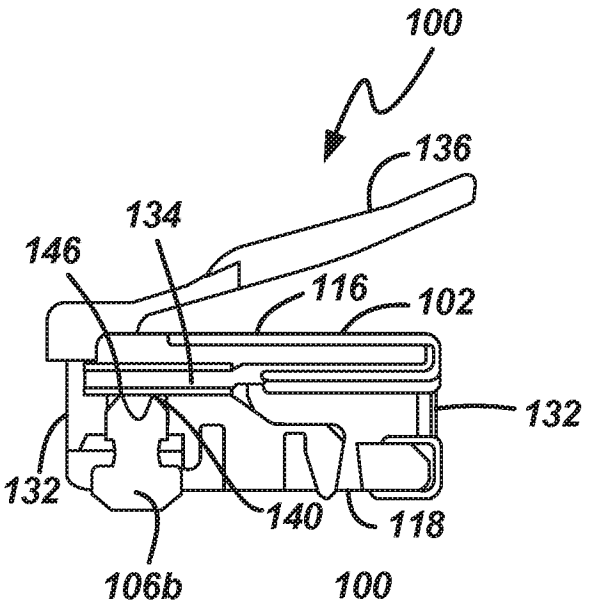
FIGS. 2A-2C provide a front, cross-sectional, and bottom view, respectively, of an example embodiment of a free connector for a single twisted pair of conductors according to the present disclosure.
Figure 2C:
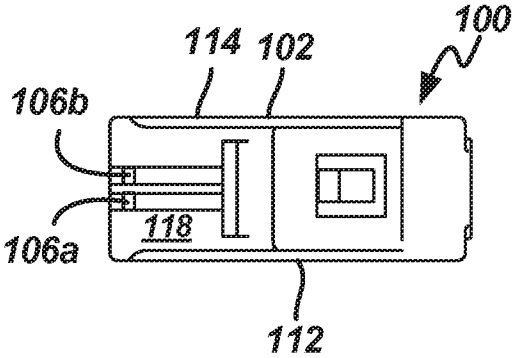
Figure 2A:
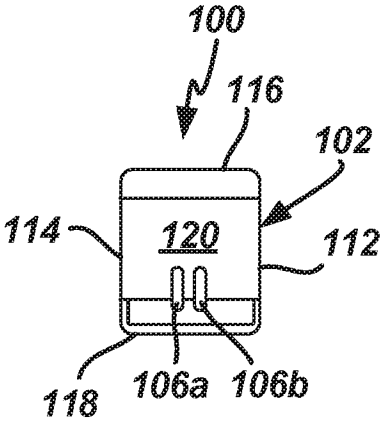
Figure 5B:
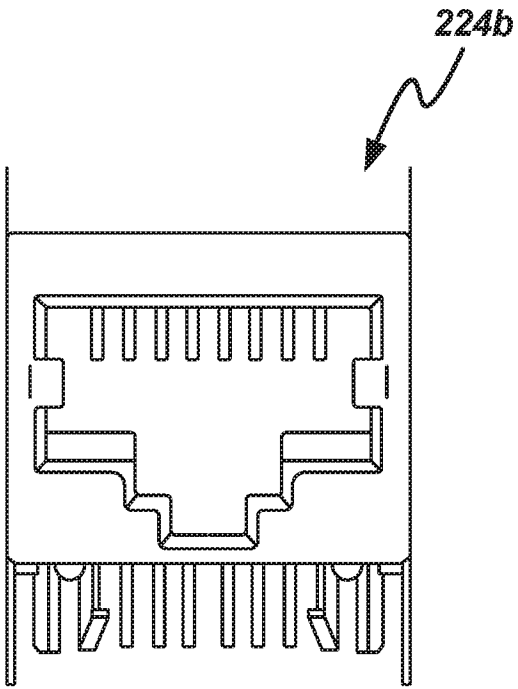
FIGS. 5A-5B provide front views of a standard RJ 45 jack/receptacle configured to interface with the RJ 45 connector of FIGS. 4A-4D.
Figure 5A:
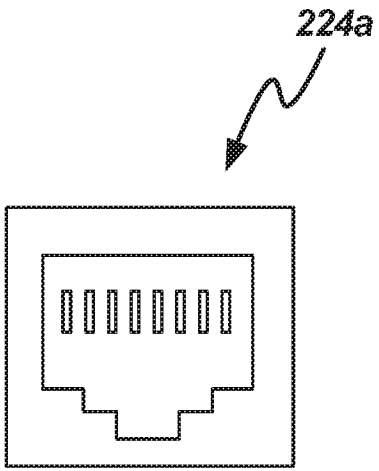

Referring to FIGS. 2A-2C, an example embodiment of a free connector 100 configured for coupling to a single twisted pair of conductors is illustrated. In certain embodiments, the free connector 100 is in the style of a registered jack (RJ) connector, e.g. RJ 45 connector, however, in a reduced footprint (e.g., the shape and size of the connector) from that of a standard RJ 45 connectors (a standard RJ 45 connector is illustrated in FIGS. 4A-4D while a standard RJ 45 jack/receptacle is illustrated in FIGS. 5A-5B). An RJ 45 style connector includes, for example, a similar appearance to a standard RJ connector that includes a substantially square elongate connector body and a snap latch on the connector body. In certain embodiments, the free connector 100 varies in dimensions and/or features from the RJ connector style. In certain embodiments, the free connector 100 is of the RJ style but is dimensionally sized according to the standards of an LC fiber optic connector, such as that illustrated in FIG. 3.

Figure 3:
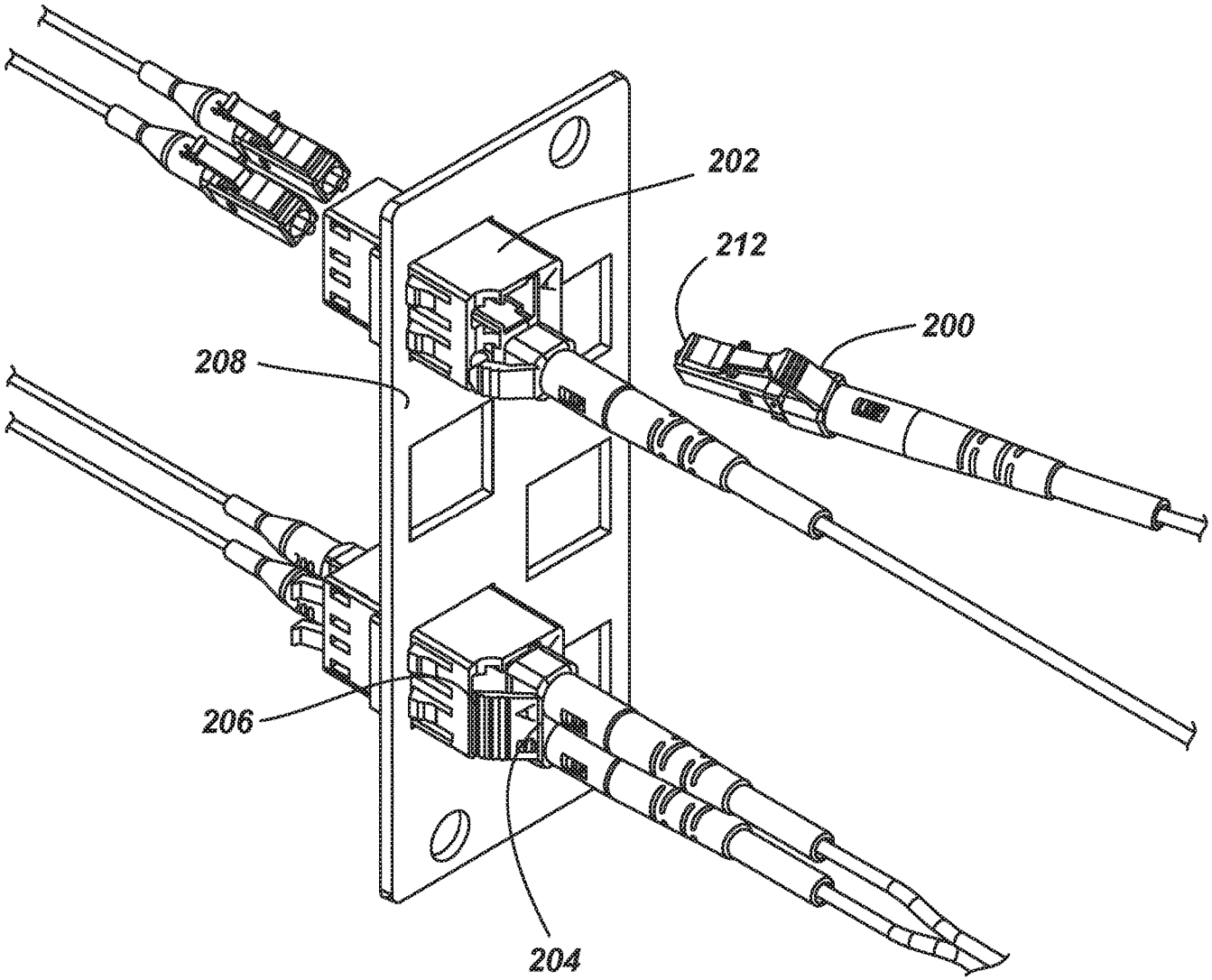
FIG. 3 illustrates an example of LC connectors configured for use with optical fibers.
Figure 4B:
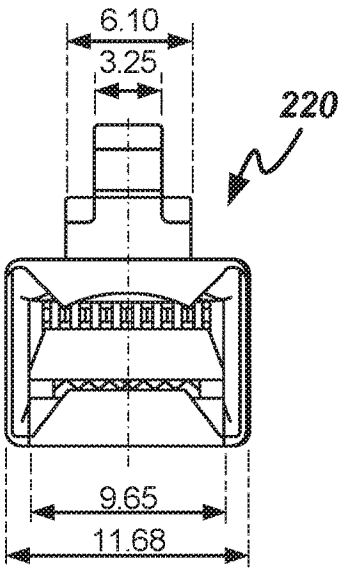
FIGS. 4A-4D provide a front, rear, top and cross-sectional view, respectively, of a standard RJ 45 connector.
Figure 4D:
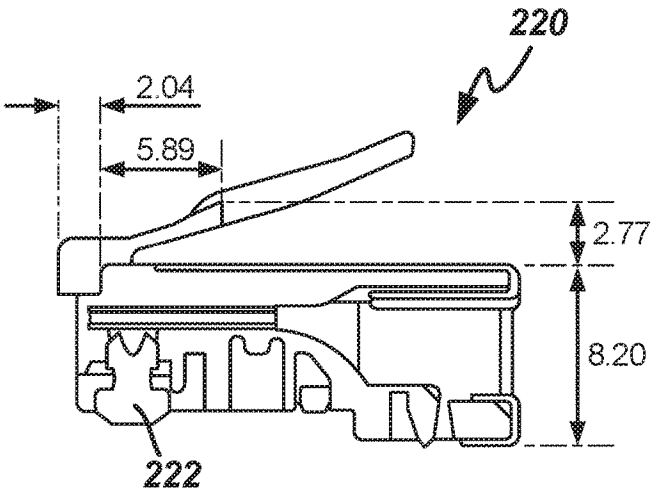
Figure 4C:
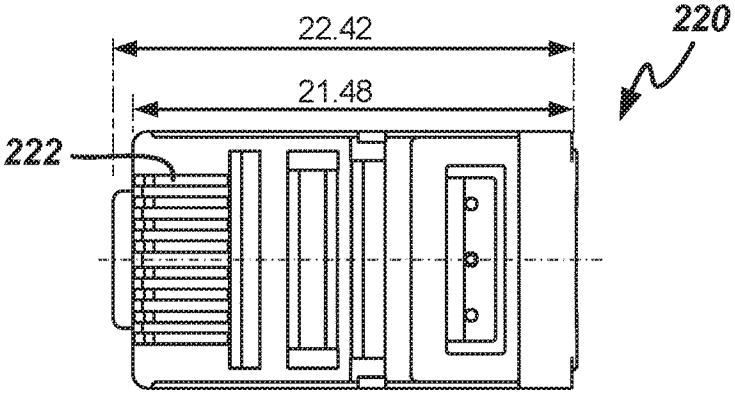
Figure 4A:
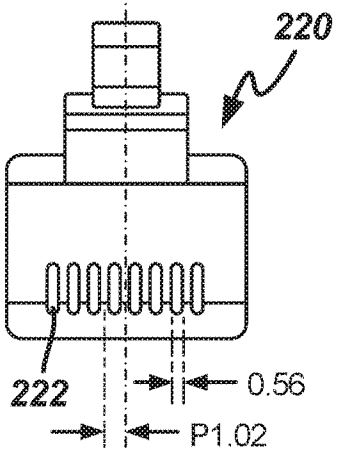

Referring to FIG. 3 an example of a simplex LC connector 200 and adapter 202, as well as a duplex LC connector 204 and adapter 206, are illustrated relative to a panel 208. A snap latch 210 is used to maintain the coupling of a connector to an adapter. The LC family of connectors, adapters and active device receptacles are generally known as small form factor connectors for use with optical fibers (1.25 mm ferrule) in high density applications, e.g., in-building communication systems. A front face 212 of a simplex LC connector is generally square having outer dimensions of 4.42 mm by 4.52 mm. The IEC (International Electrotechnical Commission) standard for an LC connector can be identified as IEC 61754-20; the noted IEC standard is hereby incorporated by reference.

Referring to FIGS. 4A-4D, an example of a standard 8-contact RJ 45 connector 220 is illustrated; dimensions are provided in mm. The RJ 45 connector 220 is configured for coupling to four twisted pairs of wires, e.g. eight wires, and includes eight contact pins 222 that are configured to pierce the insulation of wires inserted within the connector 220 upon crimping the connector 220 with a crimping tool. The connector 220 is configured to mate with a corresponding eight contact jack/receptacle 224, see FIGS. 5A-5B which illustrate a jack/receptacle 224*a* suitable for wall plate mounting and a jack/receptacle 224*b* suitable for printed circuit board (PCB) mounting and shielding, respectively. The IEC (International Electrotechnical Commission) standard for an RJ connector can be identified as IEC 60603 (all parts); the noted IEC standard is hereby incorporated by reference. Additional standards applicable to the RJ 45 connector 220 and its eight pin layout include ANSI/TIA-1096-A (American National Standards Institute/Telecommunications Industry Association) and ISO-8877 (International Organization for Standardization); each of the noted standards is hereby incorporated by reference Referring once again to FIGS. 2A-2C, the free connector 100 of the present disclosure generally includes a connector housing 102 and a single pair of contacts 106*a*, 106*b*.

The connector housing 102 of the free connector 100 includes an elongate body portion 110 having first and second side walls 112, 114 connected by upper and lower walls 116, 118, respectively, to establish a square or substantially square forward face 120. In certain embodiments, an exterior cross-sections of the connector housing 102 can assume a shape (e.g. round, oval, rectangular, triangular, hexagonal, etc.) that is different from a squared shape. The connector housing 102 further includes a channel 134 that extends from a rear face 132 toward the forward face 120; the channel 134 is configured to accommodate at least two insulated conductors (e.g. conductors 12, 14 of FIG. 1; e.g., a single twisted pair) and a jacket (e.g. jacket 18 of FIG. 1) surrounding the insulated wires.

The connector housing 102 includes a snap latch 136 on the upper wall 116 of the elongate body portion 110. The snap latch 136 can be positioned proximate the forward face 120 of the connector housing 102 as illustrated or can be positioned further rearward along the upper wall 116 as appropriate to enable a releasable interface or coupling with a corresponding fixed connector or adapter, described below.

Each of the two contacts 106*a*, 106*b* comprises a conductive pin contact having a two or three points 140 such that when the connector body 102 (with conductors inserted therein) is crimped within a crimping tool, the points 140 of the contacts 106*a*, 106*b* break through any insulation about the conductors (e.g. conductors 12, 14, see FIG. 1) to establish an electrical interface between the contacts 106*a*, 106*b* and the conductors.

The free connector 100 can be configured in a simplex form or combined in a duplex form similar to that available with LC fiber optic connectors (see FIG. 3); forms including more than two free connectors 100 are also possible.

Figure 6B:
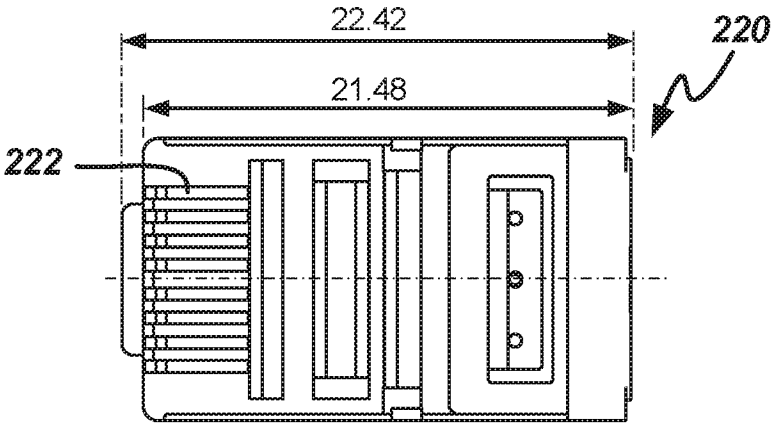
FIGS. 6A-6F are comparison schematics between an example embodiment of a free connector for a single twisted pair of conductors of the present disclosure, including a forward view (FIG. 6D), a side view (FIG. 6E) and a top view (FIG. 6F), and a standard RJ 45 connector, including a forward view (FIG. 6A), a side view (FIG. 6B), and a top view (FIG. 6C), respectively.
Figure 6C:
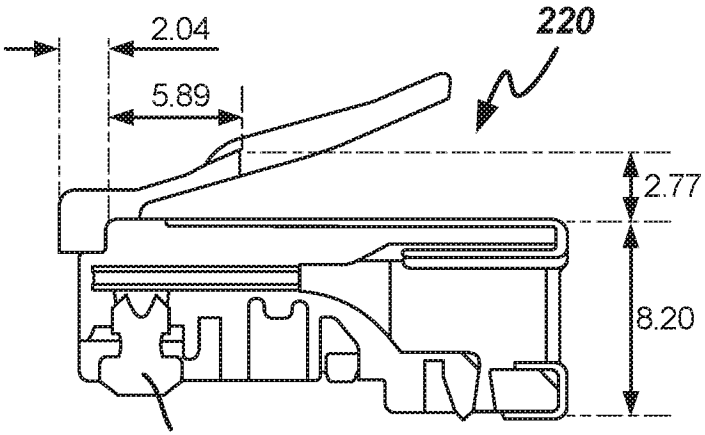
Figure 6A:
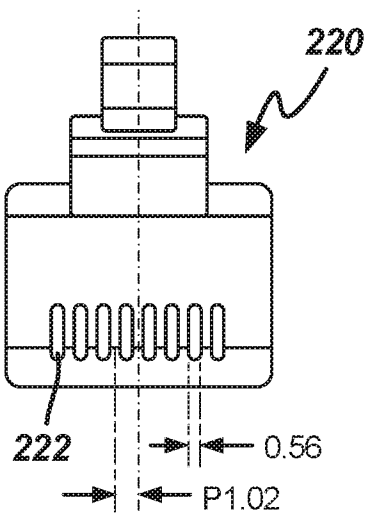
Figure 6E:
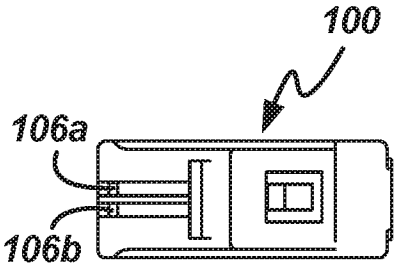
Figure 6D:
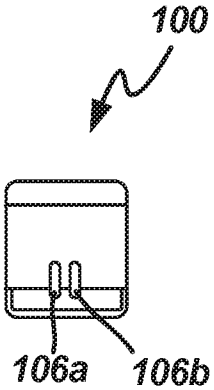
Figure 6F:
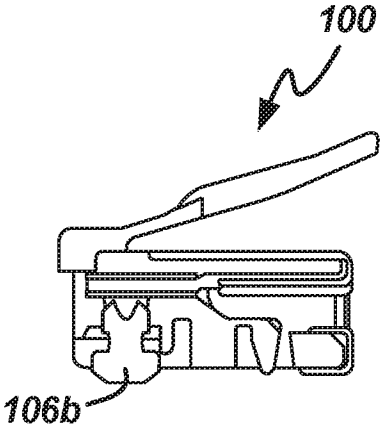

FIGS. 6A-6F illustrate the free connector 100 (FIGS. 6D-6F) relative to a standard RJ 45 connector 220 (FIGS. 6A-6C). As illustrated, the outer dimensions of the free connector 100 are significantly reduced to one-half, one-third, or even one-quarter the size of a standard RJ 45 connector 220 while using the same sized, although a reduced number of, contacts 106*a*, 106*b*; center-to-center spacing between contacts 106*a*, 106*b*, remains at a standard nominal 1.00 mm, however, other contact spacing can be utilized.

Figure 7:
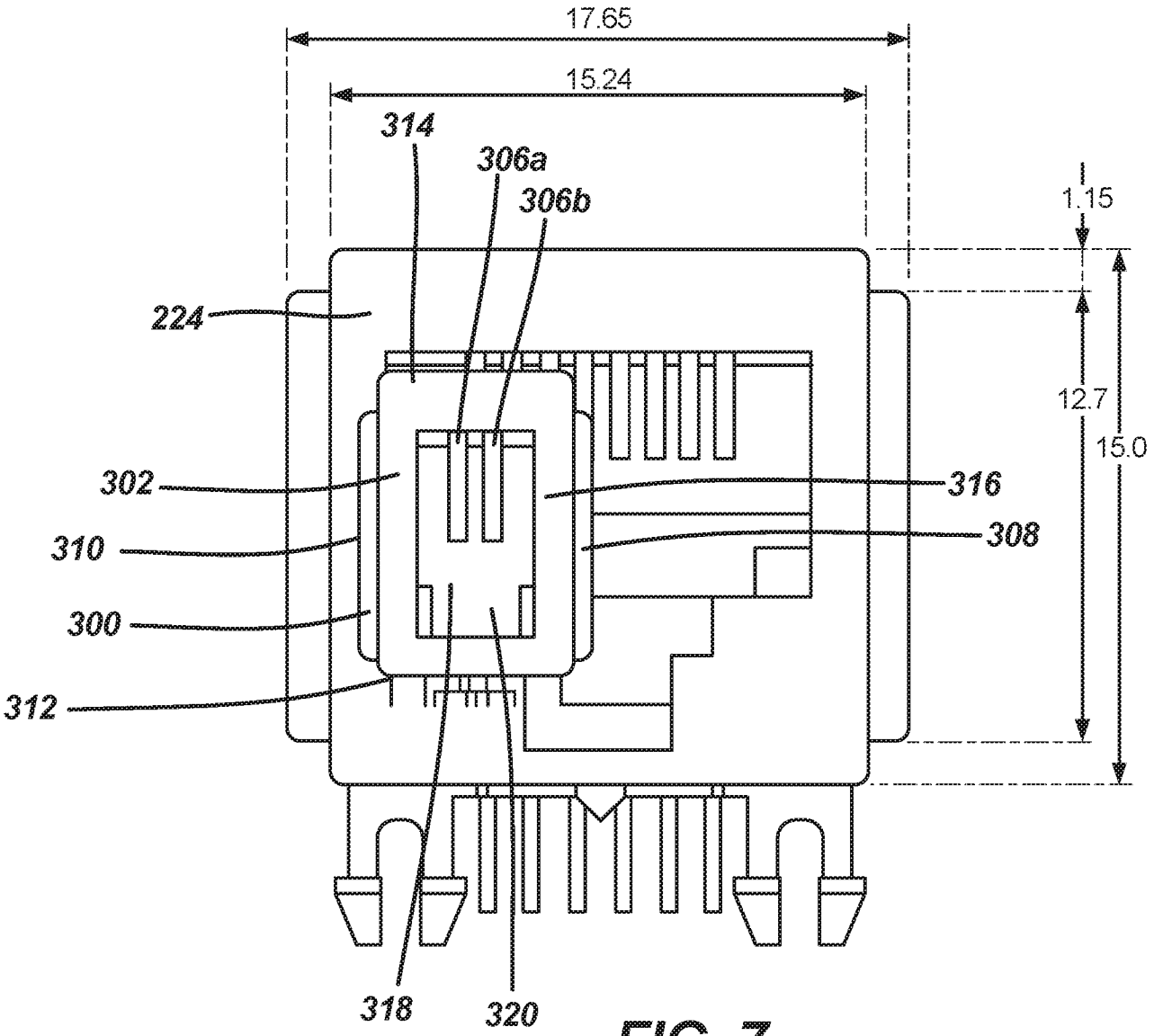
FIG. 7 is a comparison schematic between an example embodiment of a fixed connector for a single twisted pair of conductors according to the present disclosure and a standard RJ 45 jack/receptacle.

FIG. 7 illustrates an example embodiment of a fixed connector 300, which is configured to interface with the free connectors 100, in comparison to a standard RJ 45 jack/receptacle 224. Notably, the fixed connector 300 is in the style of a RJ 45 jack/receptacle, however, in a reduced footprint (e.g., shape and size of the jack/receptacle) from that of a standard RJ 45 jack/receptacle. The reduced footprint of both the free and fixed connectors 100, 300 can be one-half, one-third or one-quarter the size of a standard RJ 45 connector or jack/receptacle; other sized reductions are also possible. In certain embodiments the fixed connector 300 is of the RJ 45 style but is dimensionally sized according to the standards of an LC fiber optic receptacle (e.g. small form factor), such as that illustrated in FIG. 3. In certain embodiments, the fixed connector 300 varies in other dimensions and/or features from the RJ 45 jack/receptacle style and/or footprint.

Still referring to FIG. 7, the fixed connector 300 generally includes a body portion 302 and a single pair of contacts 306*a*, 306*b*.

The body portion 302 includes first and second side walls 308, 310 connected by upper and lower walls 312, 314. The first and second side walls 308, 310, and the upper and lower walls 312, 314 frame an open forward portion 316 that presents a port 318 within the body portion 302 that is configured to receive the free connector 100. A notch 320 proximate the upper wall 312 is configured to interface with the snap latch 136 to removably retain the free connector 100.

Each of contacts 306*a*, 306*b* comprises a spring-loaded wire contact that is configured to electrically interface with the contacts 106*a*, 106*b* of the free connector 100, when the free connector 100 is received within the port 318 of the body portion 302 of the fixed connector 300. The fixed connector 300 can be configured with a wiring bank to receive a pair of conductors for wall-mounting or cable mounting. The fixed connector 300 can also be configured for circuit board mounting, for example, with the contacts 306*a*, 306*b*, extending through the lower wall 314.

As FIG. 7 illustrates, the outer dimensions of the connector 300 are significantly reduced to one-half, one-third, or even one-quarter the size of a standard RJ 45 jack/receptacle 224 while using the same sized contacts 306*a*, 306*b*; center-to-center spacing between contacts 306*a*, 306*b*, remains at a standard nominal 1.00 mm, however other contact spacing can be utilized.

Figure 8:
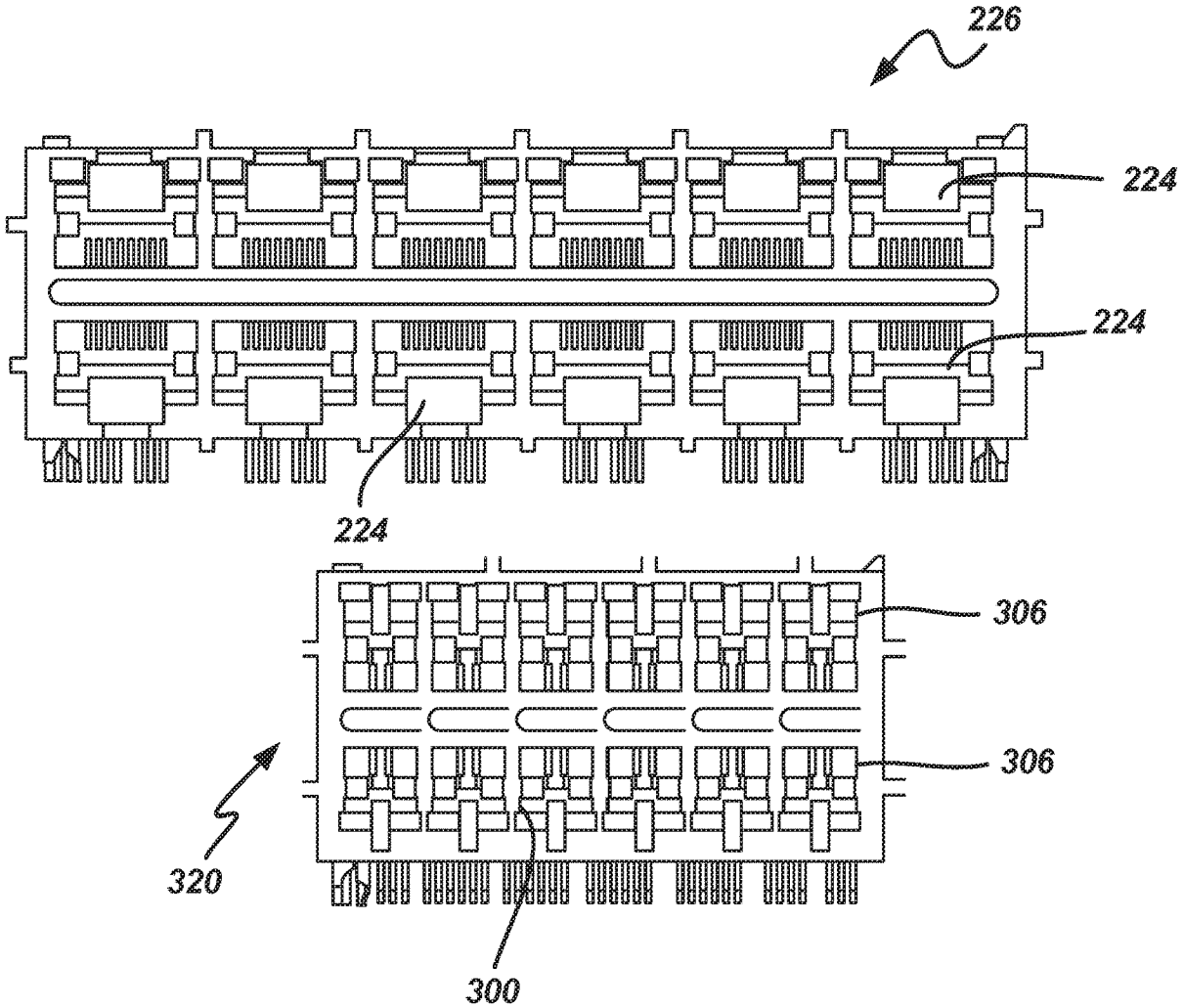
FIG. 8 is a comparison schematic between an example embodiment of a fixed connector cage incorporating a plurality of fixed connectors of the present disclosure and a multi-jack cage incorporating a plurality of standard RJ 45 jacks/receptacles.
Figure 10A:
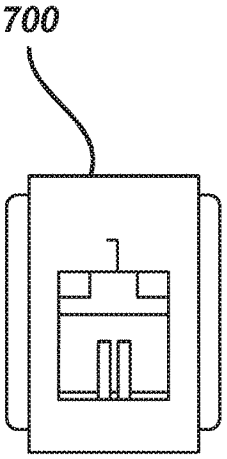
FIGS. 10A-10D illustrate a first end, second end, side and top view, respectively of an adapter configured to interface with free connector for a singled twisted pair of conductors according to the present disclosure.
Figure 10B:
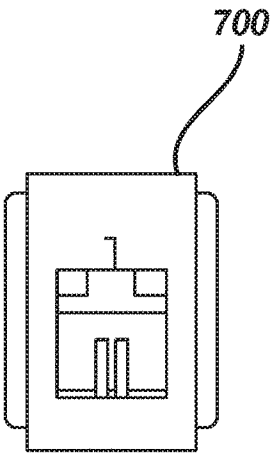
Figure 10C:
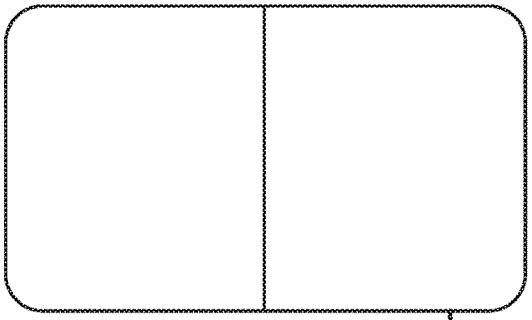
Figure 10D:
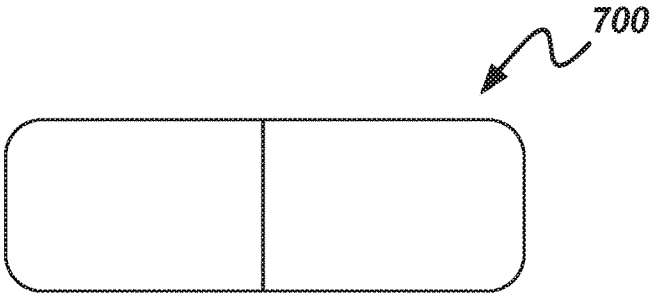

In certain embodiments, the fixed connectors 300 can be configured in a simplex form or combined in a duplex form similar to that available with LC fiber optic connectors (see FIG. 3); forms including more than two fixed connectors 300 are also possible. In certain embodiments, see FIG. 8, a plurality of fixed connectors 300 are provided in a bank 320 or cage configuration to enable coupling to a plurality of free connectors 100 in a single location. FIG. 8 illustrates the bank 320 in comparison to a bank 226 of standard RJ 45 jack/receptacles 224. Once again, the bank 320 can have dimensions that are one-half, one-third, or one-quarter the dimensions of the RJ 45 jack/receptacle bank 226; other reduced dimensions are also possible.

Figure 9:
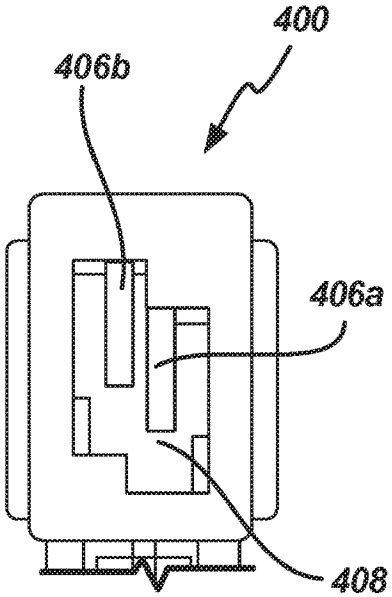
FIG. 9 illustrates an alternative contact arrangement that can be used in one or both of the free connector and fixed connector of the present disclosure.

FIG. 9 illustrates an alternative contact configuration that can be used with the both the free connector 100 and the fixed connector 300; a fixed connector 400 embodiment is illustrated. As shown, the fixed connector 400 includes an offset orientation of a pair of contacts 406*a*, 406*b*. An offset-shaped port 408, to receive a free connector with a mating interface, is also provided. Other configurations of the contacts in the free connector 100 and/or fixed connector 300 can also be used, e.g. a pair of contacts with each positioned on a separate interior face, the faces opposite or adjacent to one another.

FIGS. 10A-10D illustrates a single twisted pair adapter 700. The adapter 700 is configured to enable an in-line connection between a first free connector 100 and a second free connector 100. For example, simplex and/or duplex adapters 700 can be used in wall plate application (similar to standard electrical wall outlet) or a plurality of adapters 700 can be used in a bulkhead configuration for high density applications. The adapter 700 generally comprises a pair of fixed connectors 300 that are modified to be electrically and mechanically coupled to one another.

Figure 11A:
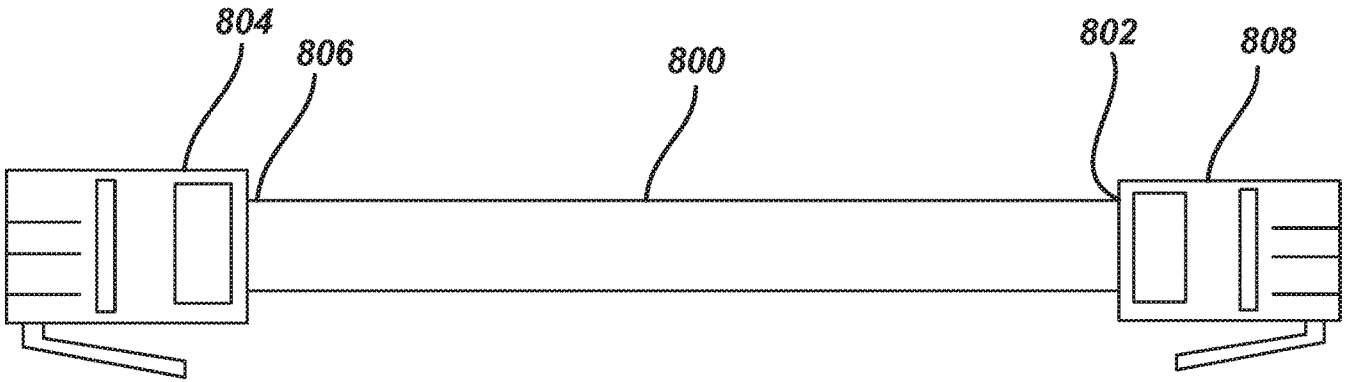
FIGS. 11A-11C illustrate various patch cord configurations utilizing the free and fixed connectors of the present disclosure.
Figure 11B:
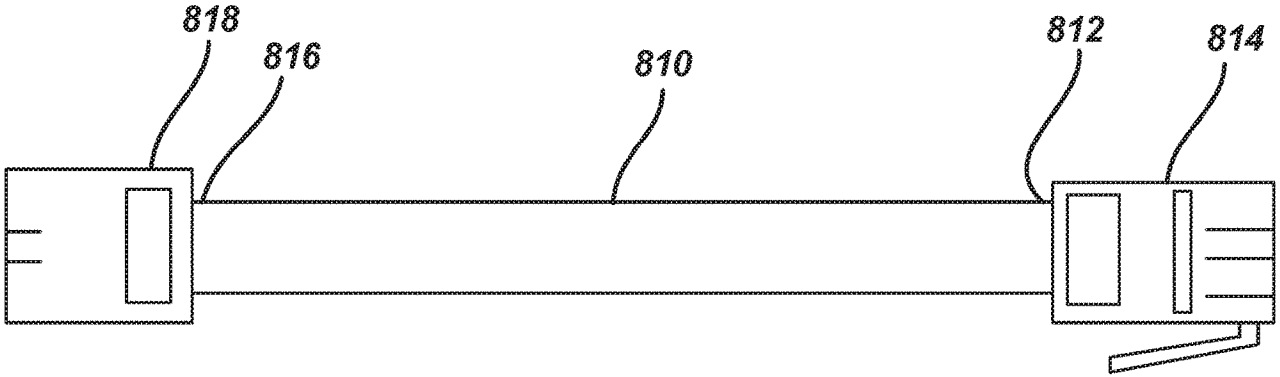
Figure 11C:
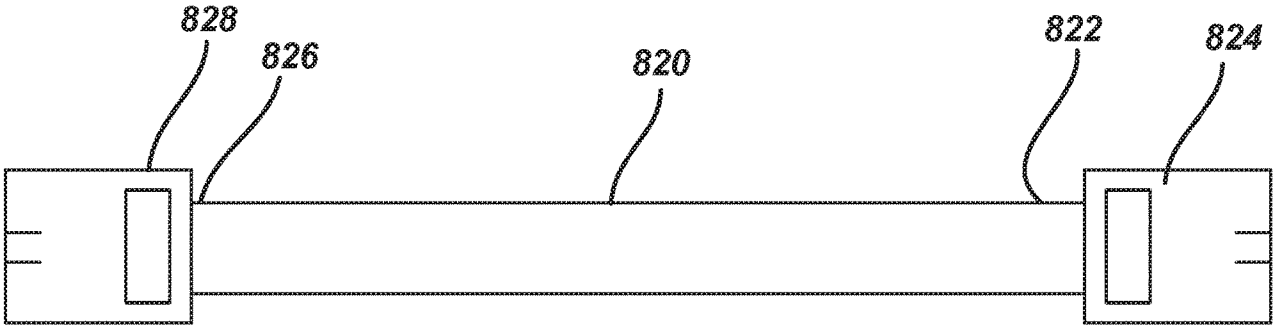

FIGS. 11A-11C illustrate various patch cord configurations that can be manufactured using the free connector 100 and the fixed connector 300. In the patch cord examples, each of the free connector 100 and the fixed connector 300 are configured for coupling with a cable having a single twisted pair of conductors (e.g. conductors 12, 14 of FIG. 1). As shown, a patch cord 800 includes a first end 802 with a first free connector 804 and a second end 806 with a second free connector 808, see FIG. 8A. FIG. 8B illustrates a patch cord 810 having a first end 812 with a first free connector 814 and a second end 816 with a first fixed connector 818. FIG. 8C illustrates a patch cord 820 having a first end 822 with a first fixed connector 824 and a second end 826 with a second fixed connector 828.

It will also be appreciated that aspects of the above embodiments may be combined in any way to provide numerous additional embodiments. These embodiments will not be described individually for the sake of brevity.

While the present invention has been described above primarily with reference to the accompanying drawings, it will be appreciated that the invention is not limited to the illustrated embodiments; rather, these embodiments are intended to disclose the invention to those skilled in this art. In the drawings, like numbers refer to like elements throughout. Thicknesses and dimensions of some components may be exaggerated for clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. It will also be understood that the terms "tip" and "ring" are used to refer to the two conductors of a differential pair and otherwise are not limiting.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A connector for a single pair of conductors comprising a first insulated conductor and a second insulated conductor, the connector comprising: a housing, wherein the housing is a reduced footprint of a standard RJ-45 housing, the reduced footprint being equal to or smaller than one-half the footprint of the standard RJ-45 housing; and exactly two electrical contacts comprising a first insulation-piercing contact that electrically interfaces with the first insulated conductor and a second insulation-piercing contact that electrically interfaces with the second insulated conductor, wherein the first and second contacts are housed by the housing; wherein the exactly two electrical contacts transmit both power and data.

2. The connector of claim 1, wherein the reduced footprint is equal to or smaller than one-third the footprint of the standard RJ-45 housing.

3. The connector of claim 2, wherein the reduced footprint is equal to or smaller than one-quarter the footprint of the standard RJ-45 housing.

4. A connector for a single pair of conductors comprising a first conductor and a second conductor, the connector comprising: a housing having a jack/receptacle body portion that includes a port, wherein the jack/receptacle body portion is a reduced footprint of a standard RJ-45 jack/receptacle, the reduced footprint being equal to or smaller than one-half the size of the standard RJ-45 jack/receptacle; and exactly two electrical contacts comprising a first spring-loaded wire contact that electrically interfaces with the first conductor and a second spring-loaded wire contact that electrically interfaces with the second conductor, wherein the two electrical contacts are accessible via the port; wherein the exactly two electrical contacts transmit both power and data.

5. The connector of claim 4, wherein the first and second conductors comprise first and second insulated conductors of an electrical cable.

6. The connector of claim 4, wherein the first and second conductors comprise first and second contacts, respectively, of a printed circuit board.

7. The connector of claim 4, wherein the reduced footprint is equal to or smaller than one-third the footprint of the standard RJ-45 jack/receptacle.

8. The connector of claim 7, wherein the reduced footprint is equal to or smaller than one-quarter the foot print of the standard RJ-45 jack/receptacle.

9. An interfacing connector system for electrically coupling a first pair of conductors with a second pair of conductors, the system comprising:

a first connector, wherein the first connector comprises:

a first housing, wherein the first housing is a reduced footprint of a standard RJ-45 housing, the reduced footprint being equal to or smaller than one-half the footprint of the standard RJ-45 housing; and exactly two electrical contacts comprising a first insulation-piercing contact that electrically interfaces with a first insulated conductor of the first pair of conductors and a second insulation-piercing contact that electrically interfaces with a second insulated conductor of the first pair of conductors, wherein the first and second contacts are housed by the first housing; and a second connector, wherein the second connector comprises:

a second housing having a jack/receptacle body portion that includes a port that receives the first connector, wherein the jack/receptacle body portion is a reduced footprint of a standard RJ-45 jack/receptacle, the reduced footprint being equal to or smaller than one-half the size of the standard RJ-45 jack/receptacle; and exactly two electrical contacts comprising a first spring-loaded wire contact that electrically interfaces with a first conductor of the second pair of conductors and a second spring-loaded wire contact that electrically interfaces with a second conductor of the second pair of conductors, wherein the two electrical contacts are accessible via the port, wherein, when the first connector is received in the port of the second connector the first pair of conductors are electrically coupled to the second pair of conductors; wherein the exactly two electrical contacts transmit both power and data.

10. The system of claim 9, wherein the first and second conductors of the second pair of conductors comprise first and second insulated conductors of an electrical cable.

11. The system of claim 9, wherein the first and second conductors of the second pair of conductors comprise first and second contacts, respectively, of a printed circuit board.

12. The system of claim 9, wherein the reduced footprint of the first housing of the first connector is equal to or smaller than one-third the footprint of the standard RJ-45 housing and wherein the reduced footprint of the jack/receptacle body portion of the second connector is equal to or smaller than one-third the footprint of the standard RJ-45 jack/receptacle.

13. The system of claim 12, wherein the reduced footprint of the first housing of the first connector is equal to or smaller than one-fourth the footprint of the standard RJ-45 housing and wherein the reduced footprint of the jack/receptacle body portion of the second connector is equal to or smaller than one-fourth the footprint of the standard RJ-45 jack/receptacle.

14. A patch cord comprising: a cable having exactly one single twisted pair of conductors comprising a first conductor and a second conductor, wherein each of the first and second conductors have first ends and second ends, and wherein the first ends of the first and second conductors are electrically coupled to a first connector and the second ends of the first and second conductors are electrically coupled to a second connector; wherein the first and second connectors each include: a housing, wherein the housing is a reduced footprint of a standard RJ-45 housing, the reduced footprint being equal to or smaller than one-half the footprint of the standard RJ-45 housing; and exactly two electrical contacts comprising a first insulation-piercing contact that electrically interfaces with the first insulated conductor and a second insulation-piercing contact that electrically interfaces with the second insulated conductor, wherein the first and second contacts are housed by the housing; wherein the exactly two electrical contacts transmit both power and data.

15. A patch cord comprising: a cable having exactly one single twisted pair of conductors comprising a first conductor and a second conductor, wherein each of the first and second conductors have first ends and second ends, and wherein the first ends of the first and second conductors are electrically coupled to a first connector and the second ends of the first and second conductors are electrically coupled to a second connector; wherein the first connector includes: a housing, wherein the housing is a reduced footprint of a standard RJ-45 housing, the reduced footprint being equal to or smaller than one-half the footprint of the standard RJ-45 housing; and exactly two electrical contacts comprising a first insulation-piercing contact that electrically interfaces with the first insulated conductor and a second insulation-piercing contact that electrically interfaces with the second insulated conductor, wherein the first and second contacts are housed by the housing; wherein the second connector includes: a housing having a jack-receptacle body portion that includes a port, wherein the jack-receptacle body portion is a reduced footprint of a standard RJ-45 jack-receptacle, the reduced footprint being equal to or smaller than one-half the size of the standard RJ-45 jack/receptacle; and exactly two electrical contacts comprising a first spring-loaded wire contact that electrically interfaces with the first conductor and a second spring-loaded wire contact that electrically interfaces with the second conductor, wherein the two electrical contacts are accessible via the port; wherein the exactly two electrical contacts transmit both power and data.

16. A patch cord comprising: a cable having exactly one single twisted pair of conductors comprising a first conductor and a second conductor, wherein each of the first and second conductors have first ends and second ends, and wherein the first ends of the first and second conductors are electrically coupled to a first connector and the second ends of the first and second conductors are electrically coupled to a second connector; wherein the first and second connectors each include: a housing having a jack/receptacle body portion that includes a port, wherein the jack/receptacle body portion is a reduced footprint of a standard RJ-45 jack/receptacle, the reduced footprint being equal to or smaller than one-half the size of the standard RJ-45 jack/receptacle; and exactly two electrical contacts comprising a first spring-loaded wire contact that electrically interfaces with the first conductor and a second spring-loaded wire contact that electrically interfaces with the second conductor, wherein the two electrical contacts are accessible via the port; wherein the exactly two electrical contacts transmit both power and data.

* * * * *